United States Patent [19]

Bogue

[11] Patent Number: 4,838,343

[45] Date of Patent: Jun. 13, 1989

[54] PORTABLE APPARATUS FOR COOLING COMPRESSED AIR

[76] Inventor: Kenneth D. Bogue, Rte. 1, Box 123A, Potts Camp, Miss. 38659

[21] Appl. No.: 142,827

[22] Filed: Jan. 11, 1988

[51] Int. Cl.[4] ..... F04B 39/06; F04B 39/16; F28D 20/00

[52] U.S. Cl. ..... 165/47; 165/10; 165/111; 165/104.19; 417/243

[58] Field of Search ..... 165/47, 104.19, 10, 165/902, 111; 417/243

[56] References Cited

U.S. PATENT DOCUMENTS

| | | | |
|---|---|---|---|
| 1,840,265 | 1/1932 | Spohrer | 417/243 |
| 1,846,655 | 2/1932 | Rayfield | 417/243 |
| 4,602,680 | 7/1986 | Bradford | 417/243 |

*Primary Examiner*—Albert W. Davis, Jr.

*Attorney, Agent, or Firm*—Walker & McKenzie

[57] ABSTRACT

A portable compressed air cooling apparatus for a compressed air system of the type including an air compressor having a compressed air outlet port, a compressed air output unit, and a compresssed air supply line having a first end coupled to the compressed air outlet port of the air compressor and having a second end coupled to the compressed air output unit. An elongated tube is provided between the compressed air outlet port of the air compressor and the compressed air output unit so that all of the compressed air passing from the compressed air outlet port of the air compressor to the compressed air output unit will pass through the tube before passing to the compressed air output unit. A hollow tank surrounds at least a portion of the tube and a liquid coolant is sealed within the tank for cooling the compressed air as the compressed air passes through the tube.

8 Claims, 1 Drawing Sheet

PORTABLE APPARATUS FOR COOLING COMPRESSED AIR

BACKGROUND OF THE INVENTION

1. Field of the Invention:

The present invention relates in general to a portable apparatus for cooling compressed air in order to prevent moisture from forming at a compressed air output means (e.g., at a paint spray gun, air wrench, etc.).

2. Description of the Related Art:

A preliminary patentability search disclosed the following patents: Clapp, U.S. Pat. No. 1,435,135; Dunn, U.S. Pat. No. 1,582,028; Spohrer, U.S. Pat. No. 1,840,265; Heed, U.S. Pat. No. 2,738,659; Huitson, U.S. Pat. No. 2,891,717; Wahl, U.S. Pat. No. 3,096,927; Brinkerhoff, U.S. Pat. No. 4,242,878; and Bradford, U.S. Pat. No. 4,602,680. None of the above patents disclose or suggest the present invention.

When air is compressed via a typical air compressor or the like, its temperature is increased. Then as the hotter compressed air contacts the cooler ambient air at a compressed air output means (e.g., at a paint spray gun or air tool, etc.), condensation forms droplets of water. The typical use of a water trap does nothing to prevent such condensation, but merely reduces the water content of the compressed air. Bradford U.S. Pat. No. 4,602,680 discloses an apparatus for being interposed in the compressed air supply line of a compressed air system for reducing the temperature of the compressed air; the Bradford apparatus includes a water reservoir, a separate heat exchanger located below the water reservoir and coupled to the water reservoir in such a manner that water will circulate between the reservoir and heat exchanger without the need for a pump or the like.

SUMMARY OF THE INVENTION

The present invention is directed toward providing an improved apparatus for use in compressed air systems for cooling compressed air in order to prevent moisture from forming at a compressed air output means (e.g., at a paint spray gun, air wrench, etc.) as the compressed air is merged with the ambient air. The concept of the present invention is to attach a portable air cooling apparatus to the air supply line between an air compressor and a compressed air output means for equalizing the temperature of the compressed air and the ambient air.

The portable compressed air cooling apparatus of the present invention is for use with a compressed air system of the type including an air compressor having a compressed air outlet port, a compressed air output means, and a compressed air supply line having a first end coupled to the compressed air outlet port of the air compressor and having a second end coupled to the compressed air output means. The apparatus of the present invention includes, in general, an elongated tube provided between the compressed air outlet port of the air compressor and the compressed air output means so that all of the compressed air passing from the compressed air outlet port of the air compressor to the compressed air output means will pass through the tube before passing to the compressed air output means, a hollow tank surrounding at least a portion of the tube, and a liquid coolant sealed within the tank for cooling the compressed air as the compressed air passes through the tube.

DESCRIPTION OF THE PREFERRED EMBODIMENT

Figure 1:
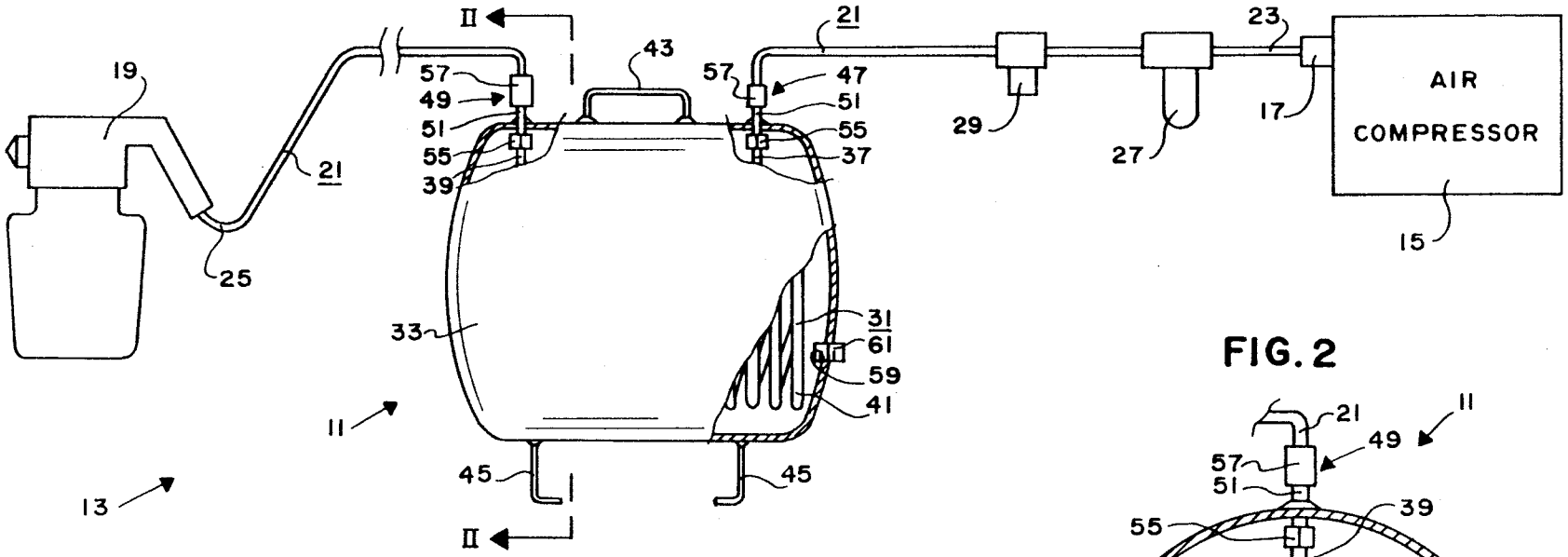
FIG. 1 is a schematic representation, partly in cross-section, of the compressed air cooling apparatus of the present invention shown in combination with a compressed air system.

The preferred embodiment of the portable compressed air cooling apparatus 11 of the present invention is used with a compressed air system 13 of the type including an air compressor 15 having a compressed air outlet port 17, a compressed air output means 19 such as a paint spray gun or air wrench or the like, and a compressed air supply line 21 having a first end 23 coupled to the compressed air outlet port 17 of the air compressor 15 and having a second end 25 coupled to the compressed air output means 19. The compressed air system 13 preferably includes a water trap 27 provided between the compressed air outlet port 17 of the air compressor 15 and the second end 25 of the compressed air supply line 21 for removing moisture from the compressed air passing from the compressed air outlet port 17 of the air compressor 15 to the second end 25 of the compressed air supply line 21, and an air regulator means 29 provided between the compressed air outlet port 17 of the air compressor 15 and the second end 25 of the compressed air supply line 21 for maintaining the compressed air between the compressed air outlet port 17 of the air compressor 15 and the second end 25 of the compressed air supply line 21 at a preset pressure. The basic construction and operation of the air compressor 15, compressed air output means 19, compressed air supply line 21, water trap 27, and air regulator means 29 are typical and well known to those skilled in the art.

Figure 2:
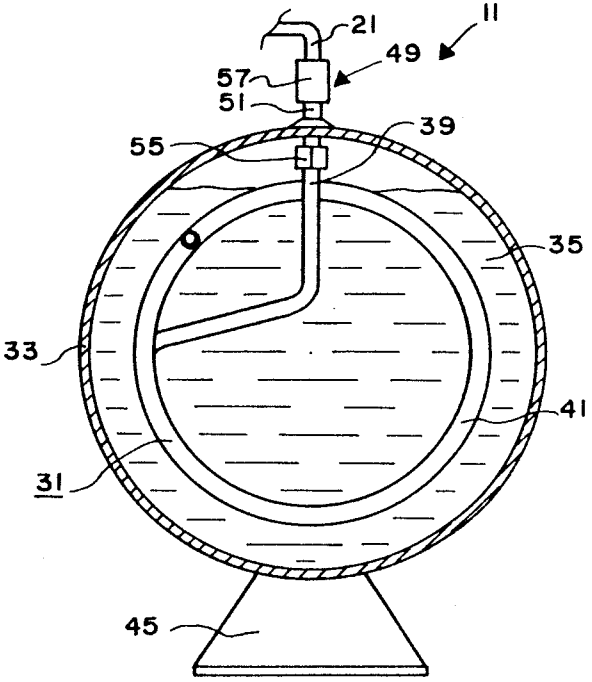
FIG. 2 is a sectional view substantially as taken on line II—II of FIG. 1.

The preferred embodiment of the portable compressed air cooling apparatus 11 of the present invention includes an elongated tube 31 provided between the compressed air outlet port 17 of the air compressor 15 and the compressed air output means 19; a hollow tank 33 surrounding at least a portion of the tube 31; and a liquid coolant 35 sealed within the tank 33 (see FIG. 2) for cooling the compressed air as the compressed air passes through the tube 31.

All of the compressed air passing from the compressed air outlet port 17 of the air compressor 15 to the compressed air output means 19 passes through the tube 31 before passing to the compressed air output means 19. The tube 31 preferably has a first end 37 for being coupled to the first end 23 of the compressed air supply line 21, a second end 39 for being coupled to the second end 25 of the compressed air supply line 21, and a coiled midportion 41 located within the tank (see, in general, FIG. 1).

The tank 33 preferably includes a handle member 43 for allowing the apparatus 11 to be easily moved and leg members 45 for supporting the apparatus 11 (see FIG. 1).

Figure 3:
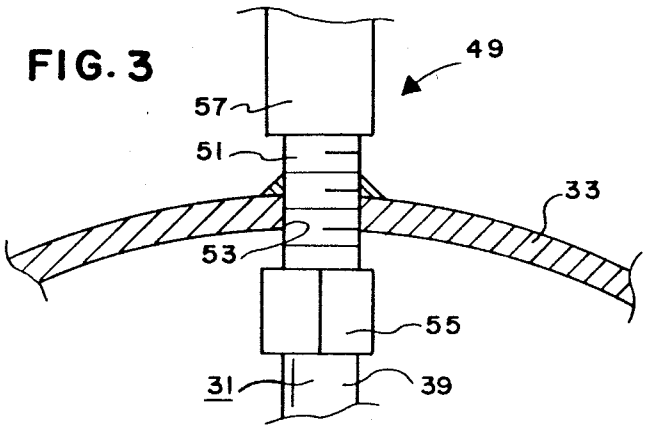
FIG. 3 is a enlarged sectional view of a portion of the compressed air cooling apparatus of the present invention.

The specific construction and size of the apparatus 11 may vary as will now be apparent to those skilled in the art. The body of the tank 33 is preferably a welded construction of 0.0625 inch thick mild steel forming a closed, cylindrical drum with an outside diameter of 12 inches and an overall length of 14 inches. More specifically, the body of the tank 33 may be formed by welding two "Bell" ends (well known to those skilled in the art) together. The handle member 43 and leg members 45 may be constructed out of 0.125 inch thick mild steel cut and bent to shape and welded to the body of the tank 33. The tube 31 is preferably constructed out of copper tubing having an outside diameter of 0.375 inches and an inside diameter of 0.250 inches. The copper tubing may be "Type L", well known to those skilled in the art. The length and diameter of the coiled midportion 41 of the tube 31 is determined by the internal dimensions of the body of the tank 33. Thus, with a tank 33 sized as disclosed above, the tube 33 may have an overall, uncoiled length of approximately 50 feet of tubing with a coiled midportion 41 of approximately 11 inches in diameter and 12 inches in length. A first coupling means 47 is preferably provided at one end of the body of the tank 33 for coupling the first end 37 of the tube 31 to the first end 23 of the compressed air supply line 21, and a second coupling member 49 is preferably provided at the other end of the body of the tank 33 for coupling the second end 39 of the tube 31 to the second end 25 of the compressed air supply line 21. Each coupling means 47, 49 preferably includes a pipe member 51 extending through an aperture 53 in the body of the tank 33 and communicating with the interior of the body of the tank 33, a first connector 55 located within the interior of the body of the tank 33 for connecting the respective ends 37, 39 of the tube 31 to the respective pipe 51, and a second connector 57 for connecting the respective ends 23, 25 of the compressed air supply line 21 to the respective pipe 51 (see, in general, FIG. 3). Each pipe 51 preferably consists of $\frac{1}{4}$ inch brass pipe nipple $1\frac{1}{2}$ inches long (well known to those skilled in the art) welded to the body of the tank 33. Each connector 55 may consist of typical brass flare-to-nipple adapters (well known to those skilled in the art). Each connector 57 may consist of one coacting part of a typical snap-fit, quick connect air hose connection (well known to those skilled in the art) to allow the apparatus 11 to be easily and quickly connected to the compressed air system 13 (i.e., the other part of the air hose connections are attached to the respective ends of the compressed air supply line 21 as shown in FIG. 1). A threaded aperature 59 is preferably provided in one end of the body of the tank 33 for receiving a threaded plug 61 (see FIG. 1) which can be removed to allow the liquid coolant 35 to be poured into the interior of the body of the tank 33 therethrough. The liquid coolant 35 preferably consists of 50 per cent ethylene glycol and 50 per cent water.

The preferred assembly of the apparatus 11 may also vary as will now be apparent to those skilled in the art. Thus, for example, the first steps may consist of drilling the various apertures 53, 59 in the body of the tank 33 and threading the aperture 59. The midportion of the copper tubing may then be formed into a coil and the pipe members 51 may be inserted into the respective apertures 53 and welded to the body of the tank 33. The ends 37, 39 of the tube 31 may then be connected to the pipe members 51 with the connectors 55, and the two "Bell" ends may be then welded together to form the body of the tank 33. The handle member 43 and leg members 45 may then be welded to the body of the tank 33. The liquid coolant 35 may then be poured through the aperture 59 into the interior of the body of the tank 33 and the plug 61 screwed thereinto to seal the liquid coolant 35 within the interior of the body of the tank 33. The connectors 57 may then be screwed onto the respective pipe members 51 whereupon the apparatus 11 will be ready for use in a manner as will now be apparent to those skilled in the art.

Although the present invention has been described and illustrated with respect to a preferred embodiment and a preferred use therefor, it is not to be so limited since modifications and changes can be made therein which are within the full intended scope of the invention.

I claim:

1. A portable compressed air cooling apparatus for a compressed air system of the type including an air compressor having a compressed air outlet port, a compressed air output means, and a compressed air supply line having a first end coupled to said compressed air outlet port of said air compressor and having a second end coupled to said compressed air output means, said apparatus comprising:

(a) an elongated tube provided between said compressed air outlet port of said air compressor and said compressed air output means, all of said compressed air passing from said compressed air outlet port of said air compressor to said compressed air output means passing through said tube before passing to said compressed air output means, said tube having a first end, a second end and a colled midportion;

(b) a hollow tank, said tank having a closed interior surrounding at least said coiled midportion of said tube; and (c) a liquid coolant sealed within said tank for cooling said compressed air as said compressed air passes through said tube.

2. The apparatus of claim 1 in which is included a first coupling means for coupling said first end of said tube to said first end of said compressed air supply line.

3. The apparatus of claim 2 in which is included a second coupling means for coupling said second end of said tube to said second end of said compressed air supply line.

4. The apparatus of claim 3 in which said first coupling means includes a pipe member communicating with said closed interior of said tank, a first connector for connecting said first end of said tube to said pipe member of said first coupling means, and a second connector for connecting said pipe member of said first coupling means to said first end of said compressed air supply line.

5. The apparatus of claim 4 in which said second coupling means includes a pipe member communicating with said closed interior of said tank, a first connector for connecting said second end of said tube to said pipe member of said second coupling means, and a second connector for connecting said pipe member of said second coupling means to said second end of said compressed air supply line.

6. The apparatus of claim 5 in which said tank includes a handle member for allowing said apparatus to be easily moved.

7. The apparatus of claim 6 in which said tank includes leg members for supporting said apparatus.

8. A portable compressed air cooling apparatus for a compressed air system of the type including an air compressor having a compressed air outlet port, a compressed air output means, a compressed air supply line having a first end coupled to said compressed air outlet port of said air compressor and having a second end coupled to said compressed air output means, a water trap provided between said compressed air outlet port of said air compressor and said second end of said compressed air supply line for removing moisture from the compressed air passing from said compressed air outlet port of said air compressor to said second end of said compressed air supply line, and air regulator means provided between said compressed air outlet port of said air compressor and said second end of said compressed air supply line for maintaining the compressed air between said compressed air outlet port of said air compressor and said second end of said compressed air supply line at a preset pressure, said apparatus comprising:

(a) an elongated tube provided between said compressed air outlet port of said air compressor and said compressed air output means, all of said compressed air passing from said compressed air outlet port of said air compressor to said compressed air output means passing through said tube before passing to said compressed air output means, said tube having a first end, a second end, and a coiled midportion;

(b) a hollow tank, said hollow tank having a closed interior surrounding at least said coiled midportion of said tube;

(c) a liquid coolant sealed within said tank for cooling said compressed air as said compressed air passes through said tube;

(d) first coupling means for coupling said first end of said tube to said first end of said compressed air supply line, said first coupling means including a pipe member communicating with the interior of said tank, a first connector for connecting said first end of said tube to said pipe member of said first coupling means, and a second connector for connecting said pipe member of said first coupling means to said first end of said compressed air supply line; and (e) second coupling means for coupling said second end of said tube to said second end of said compressed air supply line, said second coupling means including a pipe member communicating with the interior of said tank, a first connector located for connecting said second end of said tube to said pipe member of said second coupling means, and a second connector for connecting said pipe member of said second coupling means to said second end of said compressed air supply line.

* * * * *